US005322291A

United States Patent [19]

Smith et al.

[11] Patent Number: 5,322,291

[45] Date of Patent: Jun. 21, 1994

[54] GOLF PRACTICE APPARATUS

[76] Inventors: Ronald T. Smith, 20940 Bear Hollow Rd., Grass Valley, Calif. 95949; Richard B. Smith, 14426 Brooks Rd., Grass Valley, Calif. 95945

[21] Appl. No.: 58,165

[22] Filed: May 5, 1993

[51] Int. Cl.[5] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 1,598,971 | 9/1926 | Kenyon | 273/201 |
| 1,888,256 | 11/1932 | Baumgartner | 273/201 |
| 2,013,881 | 9/1935 | Fleming | 273/201 |
| 2,127,282 | 8/1938 | Beckett | 273/201 |
| 2,295,599 | 9/1942 | Mozel | 273/201 |
| 2,450,206 | 9/1948 | Shouse | 273/201 |
| 2,711,321 | 6/1955 | McGraw, Sr. | 273/201 |
| 4,602,789 | 7/1986 | Chung . | |
| 4,659,081 | 4/1987 | Cook . | |
| 4,815,744 | 3/1989 | Diamandi . | |
| 5,022,657 | 6/1991 | Bussiere . | |
| 5,078,401 | 1/1992 | Fehrenbach . | |
| 5,096,200 | 3/1992 | Komori . | |
| 5,131,661 | 7/1992 | Jorgensen . | |
| 5,133,557 | 7/1992 | Sugimoto . | |

*Primary Examiner*—Vincent Millin
*Assistant Examiner*—Steven B. Wong
*Attorney, Agent, or Firm*—John P. O'Banion; John Costello

[57] ABSTRACT

A golf practice apparatus (10) which automatically dispenses and tees golf balls (19) is disclosed herein. Depressing a foot pedal (41) coupled to a main shaft (42) actuates a reciprocating ball dispenser (50) which dispenses a single golf ball (19) to be teed upon a ball support (102). Releasing the foot pedal (41) causes an air cylinder (111) to raise the ball support (102) and teed golf ball (19) into a position for driving. The golf practice apparatus (10) of the present invention is characterized by its simplicity of function and ability to be transported by the average user.

18 Claims, 6 Drawing Sheets

GOLF PRACTICE APPARATUS

BACKGROUND OF THE INVENTION

1. Field of the Invention

This invention pertains to golf practice equipment generally, and more particularly to a ball dispensing and teeing apparatus which is manually operated by the user.

2. Description of the Background Art

Various golf practicing and teeing devices have been designed in the past, some of which were actuated by human-power alone. However, these devices were generally complex, cumbersome designs, which employed a multitude of moving parts to perform the function of teeing a golf ball for practice. These past designs were typically plagued by wear caused from friction among the multitude of moving parts, which resulted in frequent breakdowns and an increased necessity for maintenance.

For example U.S. Pat. No. 5,022,657 issued to Bussiere on Jun. 11, 1991, discloses a golf practice apparatus which is actuated by human-power means. Depression of a foot pedal by the user moves an "L" shaped shaft, one end of the "L" being connected to a tee mechanism, and the other end of the "L" being connected to a second shaft extending to a ratchet-operated ball dispensing means. The ratchet-operated ball dispensing means consists of a ball hopper with a rotating plate having numerous holes. Rotation of the plate is caused by a ratchet engaging numerous cogs in a gear mechanism, whereby when the ratchet is actuated, the plate rotates. Each time the pedal is pushed, the plate rotates, thereby allowing a single ball to be released through holes in the plate. This golf practice apparatus is reset by a system which includes a gas shock and a retracting spring.

U.S. Pat. No. 4,602,789 issued to Chung on Jul. 29, 1986, discloses a human-powered golf practice apparatus, wherein depression of a foot pedal a first time simultaneously moves three separate levers, which simultaneously causes a ball elevator to lower, four balls to be loaded onto the elevator, and a "ball raising" device to be lowered. Releasing the foot pedal causes a resiliently biased damping device to move two of the three levers, thereby simultaneously raising the ball elevator and releasing four balls onto a feed guide track. The foot pedal is then depressed a second time, simultaneously raising the ball raising device, and thereby releasing a ball and lowering a tee. When the foot pedal is released a second time, the ball elevator returns to its lower position, the tee is raised to a driving position, with a ball in place, and the ball elevator returns to the raised position, releasing more balls to the feed guide track. The ball raising device distributes one ball at a time by an elaborate mechanism which lowers and accepts a single ball from a ball tube. The ball raising device then raises and, subsequently, drops the ball onto the tee. This golf practice apparatus is reset with a biased damping device and a spring.

U.S. Pat. No. 4,659,081 issued to Cook on Apr. 21, 1987, discloses a human-powered golf practice apparatus wherein pushing a foot pedal depresses an air bellows which is connected to a second air bellows having a tee positioned on top. As the first bellows is depressed, the second bellows inflates, lifting the tee into a driving position.

In addition to human-powered golf practice apparatuses, there have been a myriad of golf practice devices driven by a variety of means other than by human-power. U.S. pat. No. 5,133,557 issued to Sugimoto on Jul. 28, 1992, discloses a golf practice apparatus with a teeing device operated by a drive mechanism dependent upon a system of hanging weights. In addition, U.S. Pat. No. 5,131,661 issued to Jorgensen on Jul. 21, 1992, U.S. Pat. No. 5,096,200 issued to Komori et al. on Mar. 17, 1992, U.S. Pat. No. 5,078,401 issued to Fehrenbach et al. on Jan. 7, 1992, and U.S. Pat. No. 4,815,744 issued to Diamandis on Mar. 28, 1989, all disclose golf practice apparatuses which depend upon non-human power sources for operation, many of which employ a motor-driven means as a source of power.

Many of the foregoing patents disclose golf practice devices which, although actuated by human-power means, employ complex mechanical systems having a multitude of moving parts for performing the function of teeing golf balls for practice. Therefore, there is a need for a human-powered golf practice apparatus which is operable using a minimal number of moving parts and is therefore less prone to breakdown and requires less maintenance. The present invention disclosed herein has fewer moving parts than previous golf practice apparatuses, and therefore performs the function of teeing a golf ball in a more efficient manner with a lower potential for breakdown and a lessened maintenance requirement.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention generally pertains to a golf practice apparatus which is actuated by human-power alone. The simple design of this invention decreases the potential for wear and breakdown and requires less maintenance than prior, more complex designs.

By way of example and not of limitation, the golf practice apparatus disclosed herein includes a ball passageway which also serves as a ball containment means. The ball passageway supplies balls to a ball support means through gravity feed. Golf balls travel down the top portion of the ball passageway, lining up behind each other when their progress is inhibited by a ball dispensing means coupled to the ball passageway. The ball dispensing means comprises an upper arm and a lower arm extending into the ball passageway. The arms slide alternately in a reciprocating motion, so that when the upper arm is fully extended into the ball passageway, the lower arm withdraws, and vice versa. The reciprocating nature of the ball dispensing means allows a single golf ball to be trapped by the lower arm when the ball dispensing means reciprocates in one direction. When the ball dispensing means reciprocates in the opposite direction, the upper arm extends into the ball passageway, thereby separating the lowest golf ball from the other golf balls lined up behind it. At the same time, the lower arm simultaneously withdraws, allowing the separated golf ball to drop down the remainder of the ball passageway to be teed upon a ball support means. The ball support means is recessed within a driving surface, the driving surface being positioned on top of a base which communicates with the ball containment means. The ball support means and the ball dispensing means are simultaneously actuated when a user pushes a foot pedal protruding above the base, which is connected to a single main shaft located inside the base. The main shaft is coupled to the ball dispensing means by a coupling means and further communicates with the ball support means by a lift rod. The lift rod in turn communicates with a parallel riser rod which is coupled to the ball support means. In the preferred embodiment, the ball passageway terminates at the ball support means, conveniently allowing the ball support means to accept a single ball dispensed by the ball dispensing means. In an alternative embodiment, the ball passageway terminates at a place other than at the ball support means and instead, the ball is released and rolls in a groove placed atop the platform, the groove eventually terminating at the ball support means. When the foot pedal is depressed by the user, the main shaft lowers, which lowers the ball support means, and reciprocates the ball dispensing means in a direction that withdraws the lower rod from the ball passageway, thereby releasing a golf ball. The golf ball rolls down the passageway to its terminus, and immediately reaches the ball support means. A tee on the ball support means tees the golf ball. When the user releases pressure upon the foot pedal, an elevating means attached to the main shaft draws the main shaft upward, which simultaneously raises the ball support means with the teed golf ball into a driving position. At the same time the elevating means is drawing the main shaft upward, a return spring causes the ball dispensing means to reciprocate in the opposite direction, simultaneously withdrawing the upper rod from the ball passageway and extending the lower rod, thereby allowing another ball to drop and rest against the lower rod, readying the ball for another dispensing cycle. The elevating means and return spring thereby serve to reset the entire golf practice apparatus for another cycle.

An object of the invention is to provide a golf practice apparatus for practicing golf swings and driving techniques.

Another object of the invention is to provide a golf practice apparatus which is actuated by human-power alone.

Another object of the invention is to provide a golf practice apparatus which is simple in design and uses few parts, thereby reducing the likelihood of wear, breakdowns and maintenance.

Another object of the invention is to provide a golf practice apparatus which is sturdy, yet light enough to be transportable.

Still another object of the invention is to provide a golf practice apparatus which is inexpensive to operate.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
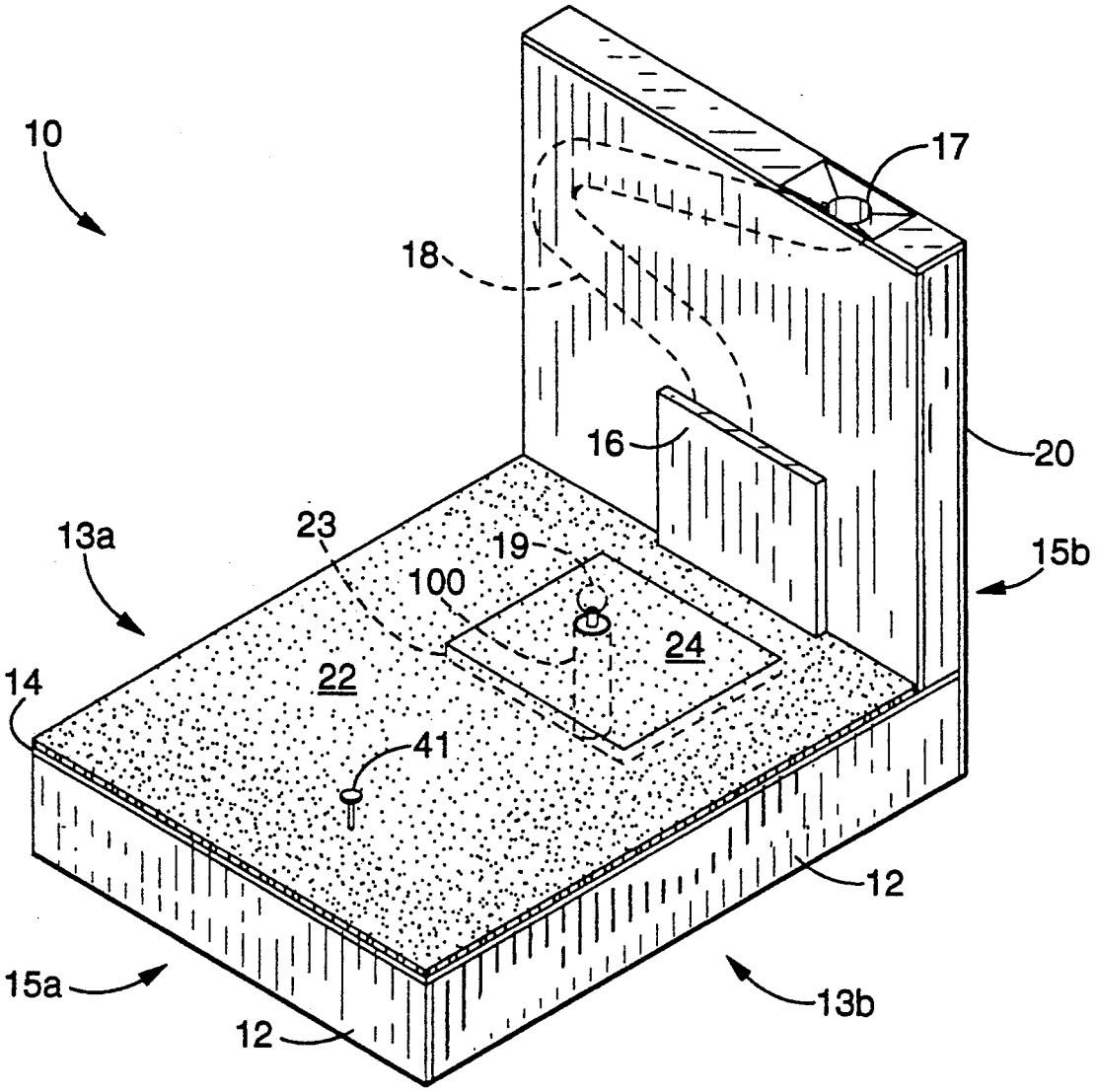
FIG. 1 is a perspective view of the apparatus of the present invention.

Referring more specifically to the drawings, for illustrative purposes the present invention is embodied in the apparatus generally shown in FIG. 1. It will be appreciated that the apparatus may vary as to configuration and as to details of the parts without departing from the basic concepts as disclosed herein.

FIG. 1 illustrates the general configuration of the golf practice apparatus 10 of the present invention. The golf practice apparatus 10 has a base 12 having sides 13*a*, 13*b* and ends 15*a*, 15*b* with a longitudinal axis extending between ends 15*a*, 15*b* and a lateral axis extending between sides 13*a*, 13*b*. The base 12 is preferably generally rectangular. Ball dispenser support 20 is coupled to the back of base 12. Ball dispenser support 20 includes a cover plate 16, ball opening 17 and ball passageway 18. A platform 14, upon which is situated a generally planar practice surface 22, covers base 12 so that a user may stand for purposes of driving golf balls.

Figure 2:
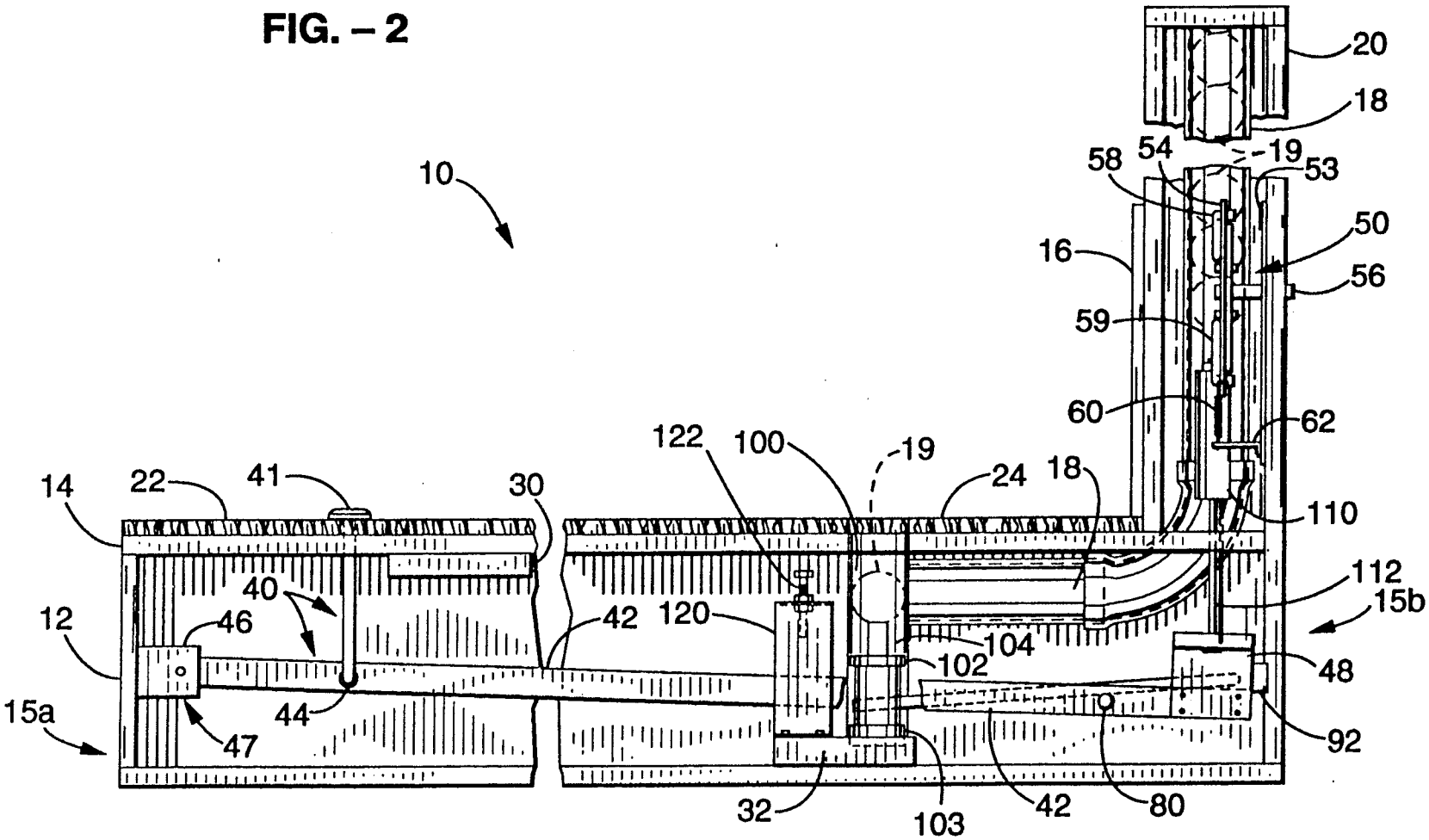
FIG. 2 is a side elevation view of the apparatus depicted in FIG. 1 with side panels removed to show the relation of the internal mechanical elements of the invention.

Referring to both FIG. 1 and FIG. 2, it can be seen that protruding through practice surface 22 is foot pedal 41 which, along with main shaft 42, comprises the actuating means 40 for golf practice apparatus 10 in the preferred embodiment. Practice surface 22 has a cutout 23 in which is laid a driving surface 24. Driving surface 24 can be fastened inside cutout 23 by any suitable means. In the preferred embodiment, should driving surface 24 wear out, it may be removed and replaced with a new driving surface 24. Playing surface 22 and driving surface 24 may be composed of a plurality of durable surfaces, including, preferably, one of the many false turf surfaces commonly used for putting and driving applications. In an alternative embodiment, practice surface 22 and driving surface 24 may have a continuous groove cut into both surfaces for purposes of allowing a golf ball 19 to travel across them. Recessed within driving surface 24 is ball guide means 100, wherein ball support means 102 resides. In the preferred embodiment, ball guide means 100 is a riser tube.

Figure 3:
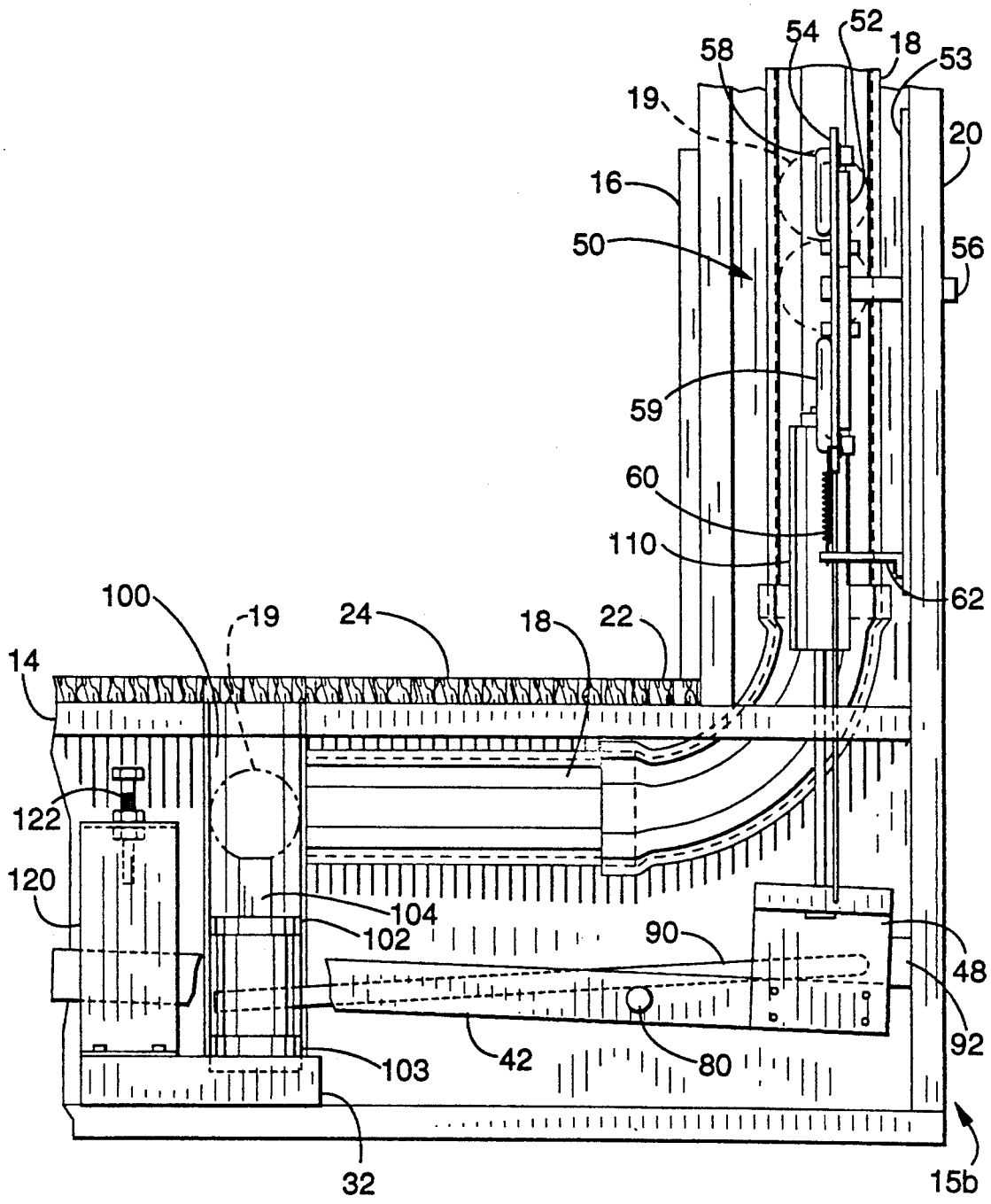
FIG. 3 is a detail view of a portion of the apparatus depicted in FIG. 2.
Figure 4:
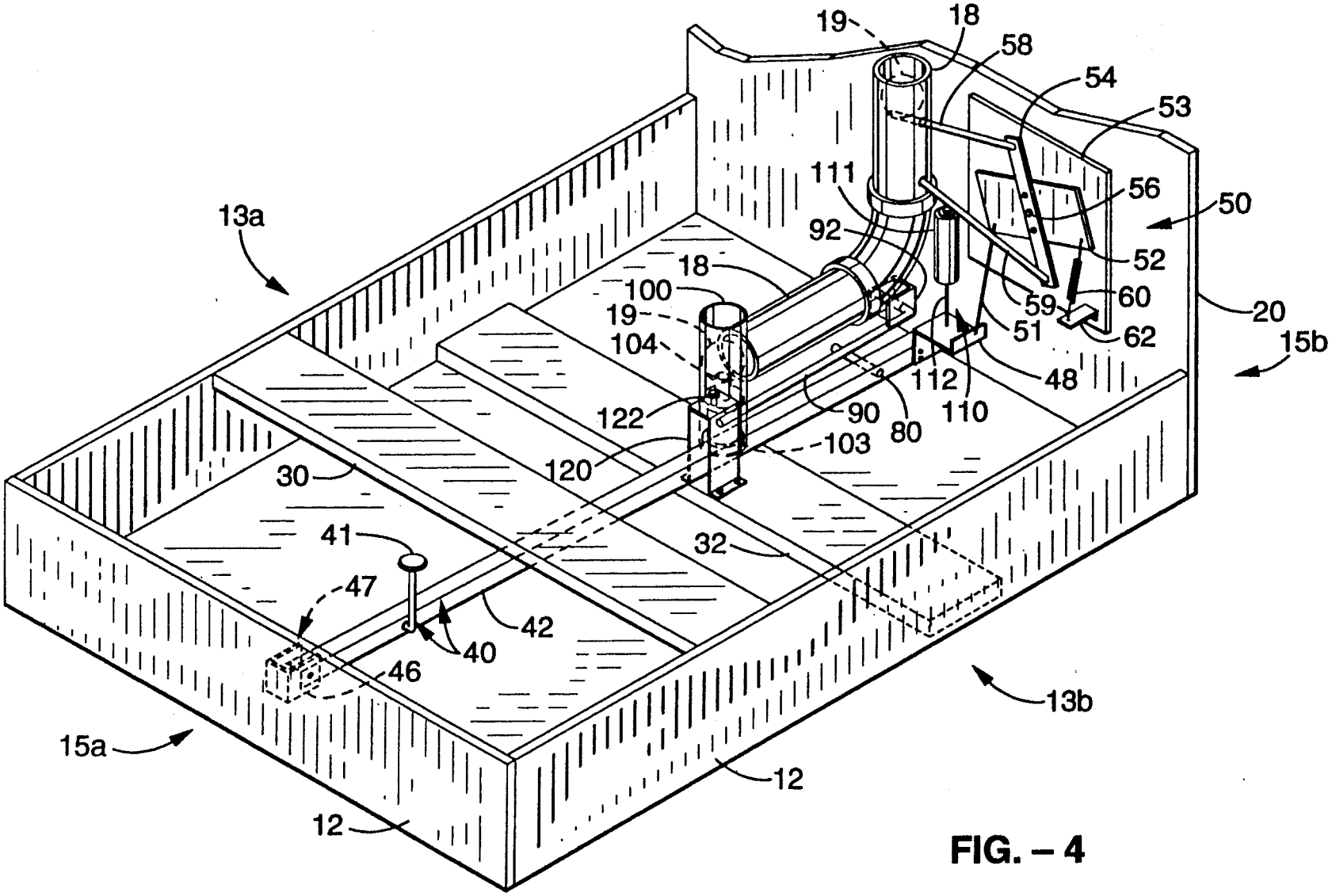
FIG. 4 is a perspective view of the apparatus of FIG. 1 showing the internal mechanical elements.

FIG. 2 and FIG. 3 illustrate the various mechanical assemblies inside base 12. These views show that base 12 is stabilized by cross braces 30 and 32. It can also be seen that actuating means 40 includes a foot pedal 41 attached to a main shaft 42 by pivot means 44. Main shaft 42 is horizontally disposed along the longitudinal axis of base 12, main shaft 42 being attached to base 12 at a first end by support 46 and pivot means 47. Pivot means 44 and 47 may be chosen from a variety of pivoting mechanisms, but in the preferred embodiment, pivot pins are used. At a second end, main shaft 42 is operatively coupled to ball dispensing means 50. Coupling between main shaft 42 and ball dispensing means 50 is achieved by a support 48, which in the preferred embodiment as seen in FIG. 4, is an "L" bracket where one area of the "L" is connected to the main shaft 42 and another area of the "L" is connected to both an elevating means 110 and the lower end of coupling means 51. Coupling means 51 may be chosen from a variety of means suitable for coupling support 48 to ball dispensing means 50, but in the preferred embodiment a metal rod has been found to perform optimally as a coupling means 51. Coupling means 51 extends vertically upward from support 48 and main shaft 42 to connect at its upper end to ball dispensing means 50.

Figure 5:
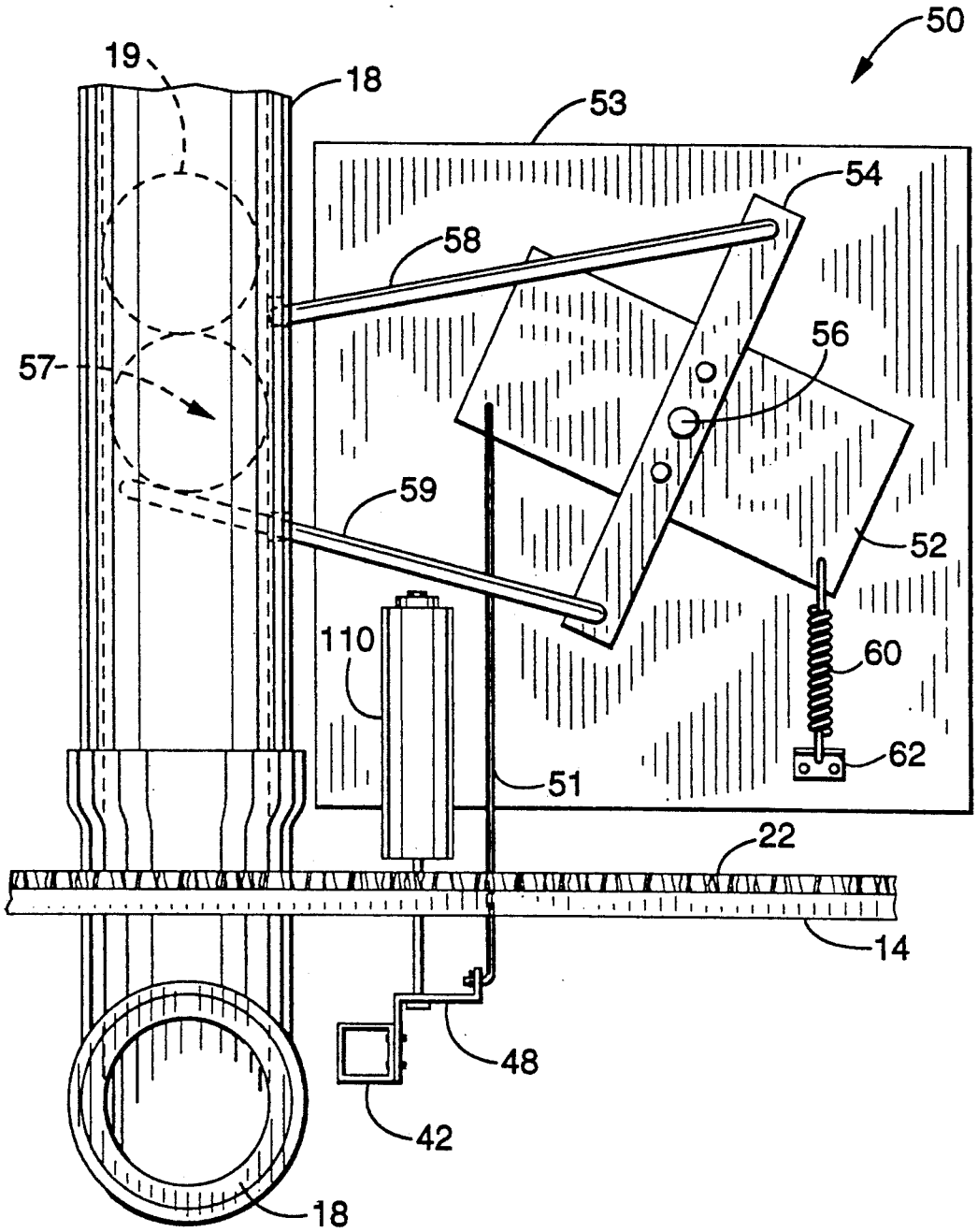
FIG. 5 is a front elevation view of the ball dispensing means of the apparatus depicted in FIG. 1.

Ball dispensing means 50 is shown in its preferred embodiment in greater detail in FIG. 5. Ball dispensing means 50 includes plate 52, upper arm 58 and lower arm 59. Coupling means 51 is attached at its upper end to the proximal edge of plate 52 in relation to ball passageway 18. The distal edge of plate 52 in relation to ball passageway 18 is attached to the upper end of return spring 60. Return spring 60 is attached at its lower end to support 62. Plate 52 has the ability to reciprocate rotatably as a result of opposing tension being applied by coupling means 51 and return spring 60, which in combination with plate 52 comprise a reciprocating means. The reciprocating motion of plate 52 is aided by pivotal attachment means 56 which is preferably mounted centrally in plate 52, to allow plate 52 to reciprocate in a balanced manner, when tension is applied by coupling means 51 and return spring 60. Pivotal attachment means 56 may be derived from a plurality of pivot mechanisms, but in the preferred embodiment is a pivot pin. Pivotal attachment means 56 is preferably attached to ball dispenser support 20, thereby adequately supporting ball dispensing means 50. Additionally, plate 52 pivots against wear surface 53 which is penetrated by pivotal attachment means 56. Wear surface 53 is coupled to ball dispenser support 20 and serves to protect ball dispenser support 20 from wear caused by the reciprocation of plate 52. Mounted upon plate 52 is support 54, which in the preferred embodiment is a vertical bracket having top and bottom ends. Also, preferably support 54 is centrally mounted upon plate 52 and is penetrated at a central location by pivotal attachment means 56. Support 54 has pivotally mounted at its top and bottom ends upper arm 58 and lower arm 59, respectively. In the preferred embodiment, upper arm 58 and lower arm 59 are a substantially elongate pair of rods which are slidably disposed in ball passageway 18 and separated by a vertical gap 57 having a distance approximate to the diameter of a golf ball. By limiting the size of gap 57 between arms 58 and 59 to the approximate diameter of a single golf ball, the preferred embodiment succeeds in preventing more than one golf ball from entering gap 57, thereby eliminating the potential for jammed balls. When arms 58 and 59 are fully extended into ball passageway 18, golf balls 19 are effectively blocked and prevented from travelling downward. Arms 58 and 59 are also preferably tapered at their ends to allow for the easy separation of golf balls 19 from each other. Tapering the ends of arms 58 and 59 further eliminates the possibility of ball jamming, since the tapered ends can slide easily between the junction of two balls, thereby separating the golf balls 19 with little difficulty. In the preferred embodiment, ball passageway 18 is a tube having first and second ends, the tube being of a diameter approximate to that of a golf ball, so that a single golf ball at a time may pass freely through the tube. Additionally it is important to note that ball passageway 18 serves a dual purpose as first, a ball passageway through which golf balls can travel and, secondly, as a ball containment means for containing a plurality of golf balls. It has been found that by allowing ball passageway 18 to serve as both a ball passageway and a ball containment means, the potential for having jammed golf balls is virtually eliminated. Thus, ball passageway 18 is loaded with a plurality of golf balls 19 through ball opening 17. Ball opening 17 may be adapted with a barrier or other means for facilitating easy acceptance of golf balls 19 during the golf ball loading procedure.

Referring again to FIG. 4 as well as FIG. 5, actuating means 40 is actuated by depressing foot pedal 41, which subsequently depresses main shaft 42 and coupling means 51, which in turn pivots ball dispensing means 50 in one direction, causing lower arm 59 to slidably withdraw from ball passageway 18, and further causing a ball 19 to drop down the remainder of ball passageway 18 toward ball support means 102. Simultaneously, with the downward movement of coupling means 51, upper arm 58 slidably advances into the ball passageway 18, thereby inhibiting the movement of the stack of golf balls 19 above upper arm 58. Also, simultaneous with the downward movement of coupling means 51, return spring 60 undertakes a tensioned state, such that when downward tension upon said main shaft 42 is released, the corresponding downward tension on coupling means 51 is released, and return spring 60 in its tensioned state possesses enough stored energy to pivot ball dispensing means 50 in the direction opposite from that caused by the downward motion of coupling means 51, such that upper arm 58 is slidably withdrawn from ball passageway 18, thereby allowing another ball to drop onto lower arm 59 which has simultaneously slidably advanced into ball passageway 18.

Figure 6:
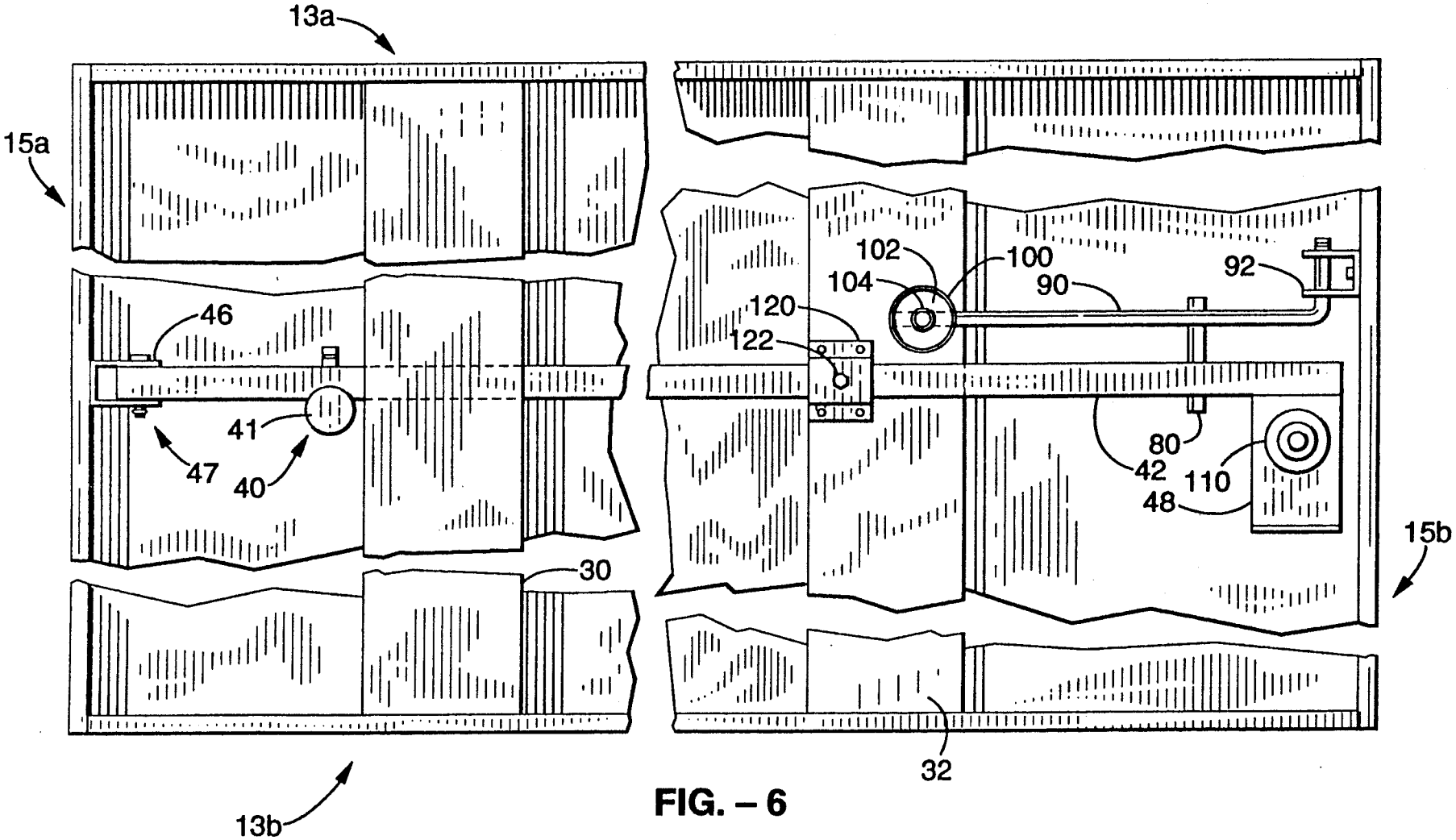
FIG. 6 is a plan view of the apparatus of FIG. 4 with the playing surface removed to show the communication between the various internal mechanical elements.

As seen in FIG. 2 and FIG. 6, golf balls 19 which are released by ball dispensing means 50 travel down the remainder of ball passageway 18 until they reach ball support means 102 which comprises a base 103 and a tee 104. Ball support means 102 is recessed within ball guide means 100 and is vertically slidable within ball guide means 100 so that ball support means 102 can slide vertically between an upper and a lower position. In the preferred embodiment, ball passageway 18 travels beneath platform 14, terminating at ball guide means 100, at a height sufficient to deliver golf balls 19 upon the top of tee 104 when ball support means 102 is in a lowered position. In an alternative embodiment, a groove having two ends is cut into playing surface 22 and driving surface 24, the groove receiving golf balls 19 from ball passageway 18 at its first end, and delivering golf balls 19 atop platform 14 to ball support means 102 at its second end. It has been found that if golf balls 19 travel atop platform 14, instead of beneath it, space required to accommodate ball passageway 18 beneath platform 14 is eliminated, and base 12 can subsequently have a lower profile. By configuring base 12 with a lower profile, the user's task of mounting the apparatus 10 to drive golf balls 19, is simplified.

Referring to FIG. 3, FIG. 4 and FIG. 6 together, the means for alternating ball support means 102 between its upper and lower positions is shown. Riser rod 90 is connected to ball support means 102 at one end and is pivotally connected at its opposite end to support 92. Riser rod 90 is substantially parallel with main shaft 42 and communicates with main shaft 42 by engagement means 80. In the preferred embodiment, engagement means 80 is a lift rod fastened to main shaft 42 and spans the gap between main shaft 42 and riser rod 90 in a substantially perpendicular fashion. Also in the preferred embodiment, riser rod 90 is not fastened to engagement means 80, but instead merely rests upon engagement means 80. Engagement means 80 allows riser rod 90 to move simultaneously with the motion of main shaft 42. Hence, when main shaft 42 lowers, the following simultaneous events occur: arms 58, 59 reciprocate, thus releasing a golf ball 19 down ball passageway 18. At the same time main shaft 42 lowers, riser rod 90 lowers, thereby lowering ball support means 102, allowing tee 104 to be in a lowered position for accepting a golf ball 19 from ball passageway 18.

While the lowering of riser rod 90, lowering of ball support means 102, and reciprocation of arms 58, 59 are all simultaneously accomplished with the lowering of main shaft 42, the subsequent resetting of all these elements is not achieved by similar, nor simultaneous means. As shown in FIG. 4, actuating means 40 is subsequently reset into an elevated position by elevating means 110. Along with actuating means 40, elevating means 110 also simultaneously elevates riser rod 90 and ball support means 102. However, elevating means 110 does not simultaneously reset ball dispensing means 50, since this is accomplished by the energy stored in return spring 60. In the preferred embodiment, elevating means 110 is an air cylinder 111 with a shaft 112, the air cylinder 111 being attached at shaft 112 along with coupling means 51 to main shaft 42 by bracket 48. Also in the preferred embodiment, air cylinder 111 is adjustable, such that the speed which the ball support means reaches an elevated position can be regulated.

As seen in FIG. 2 and FIG. 4, when elevating means 110 elevates ball support means 102, the tee 104 with golf ball 19 in place is raised to an elevation above driving surface 24, which is sufficient for efficient driving of golf ball 19. FIG. 4 along with FIG. 3 shows main shaft bracket 120 possessing a main shaft vertical height adjuster 122. The main shaft vertical height adjuster 122 limits the vertical travel of the main shaft 42, thereby simultaneously limiting the vertical travel of riser rod 90 which subsequently limits the height of ball support means 102. By being able to adjust the height which elevating means 110 can elevate main shaft 42, the goal of adjusting the driving height of tee 104 can be achieved. As a result, vertical height adjuster 122 allows tee 104 to be raised or lowered depending on a user's preference. In the preferred embodiment, vertical height adjuster 122 is a bolt with two adjustable nuts. The main shaft 42 will travel upward due to elevating means 110, until it contacts the blunt end of the bolt of the vertical height adjuster 122 in the preferred embodiment, thus preventing further upward vertical travel of main shaft 42 and simultaneously limiting the height of tee 104.

The materials chosen for all the various elements of golf practice apparatus 10 may be selected from a variety of materials which are suitable for achieving the objectives of the invention. In the preferred embodiment, the moving metal parts are preferably stainless steel wherever practical, due to the superior wear characteristics and rust protection afforded by stainless steel.

Accordingly, it will be seen that this invention provides a human-powered golf practice apparatus which is of a simple, dependable, design which is less prone to breakdown and requires less maintenance than previous designs. The present invention also provides a golf practice apparatus which is transportable. Although the description above contains many specificities, these should not be construed as limiting the scope of the invention but as merely providing illustrations of some of the presently preferred embodiments of this invention. Thus the scope of this invention should be determined by the appended claims and their legal equivalents.

We claim:

1. A golf practice apparatus, comprising:

(a) a base, said base including a generally planar practice surface, said base having opposing ends;

(b) ball support means for supporting at least one golf ball;

(c) ball guide means , said ball guide means coupled to said base, said ball support means slidably disposed within said ball guide means;

(d) a ball passageway, said ball passageway having first and second ends, said first end adapted for receiving a plurality of golf balls, said ball passageway communicating with said ball guide means;

(e) ball dispensing means for dispensing a golf ball into said ball guide means, said ball dispensing means coupled to said ball passageway;

(f) reciprocating means for imparting reciprocating motion to said ball dispensing means;

(g) actuating means for actuating said ball dispensing means and said ball support means, said actuating means including a pedal pivotally coupled to a substantially linear main shaft, said main shaft having first and second ends, said first end pivotally coupled to a one of said opposing ends of said base;

(h) said reciprocating means including coupling means for operatively coupling said reciprocating means to said second end of said main shaft; and (i) a riser rod, said riser rod operatively coupled to said ball support means, said riser rod and said ball support means movable by actuation of said main shaft.

2. An apparatus as recited in claim 1, wherein said actuating means simultaneously actuates said ball dispensing means and said ball support means.

3. An apparatus as recited in claim 1, further comprising resetting means for placing said ball support means and said actuating means into a reset position.

4. A golf practice apparatus, comprising:

(a) a base having a plurality of sides and a substantially planar practice surface, said base having opposing ends;

(b) ball support means for supporting a golf ball;

(c) bass guide means, said ball guide means coupled to said base, said ball support means slidably disposed within said ball guide means;

(d) a ball passageway, said ball passageway having first and second ends, said first end adapted for receiving a plurality of golf balls, said second end communicating with said ball guide means;

(e) ball dispensing means for selectively dispensing a golf ball from said ball passageway into said ball guide means, said ball dispensing means coupled to said ball passageway;

(f) reciprocating means for imparting reciprocating motion to said ball dispensing means;

(g) actuating means for actuating both said ball dispensing means and said ball support means, said actuating means including a pedal pivotally coupled to a substantially linear main shaft, said main shaft having first and second ends, said first end pivotally coupled to a one of said opposing ends of said base;

(h) said reciprocating means including coupling means for operatively coupling said reciprocating means to said second end of said main shaft; and (i) a riser rod, said riser rod operatively coupled to said ball support means, said riser rod and said ball support means movable by actuation of said main shaft.

5. An apparatus as recited in claim 4, wherein said actuating means simultaneously actuates said ball dispensing means and said ball support means.

6. An apparatus as recited in claim 4, wherein said elevating means simultaneously elevates said ball support means and said actuating means into a reset position.

7. An apparatus as recited in claim 4, wherein said ball dispensing means comprises:

(a) an upper arm, said upper arm having first and second ends;

(b) a lower arm, said lower arm having first and second ends;

(c) said upper and lower arms being separated by a gap, said first ends of said upper and lower arms extending into said ball passageway, said upper and lower arms slidably disposed in said ball passageway; and (d) said second ends of said upper and lower arms coupled to a plate.

8. An apparatus as recited in claim 7, wherein the width of said gap between said upper and lower arms is approximate to the diameter of a golf ball.

9. An apparatus as recited in claim 7, wherein said upper and lower arms are substantially elongate, whereby said upper and lower arms effectively block said ball passageway, and inhibit the passage of said golf balls.

10. An apparatus as recited in claim 7, wherein said upper and lower arms are substantially tapered at said first ends.

11. A golf practice apparatus, comprising:

(a) a base having a plurality of sides and a substantially planar practice surface, said base having opposing ends;

(b) ball support means for supporting a golf ball;

(c) a ball passageway, said ball passageway having first and second ends, said first end adapted for receiving a plurality of golf balls;

(d) ball guide means, said ball guide means coupled to said base and communicating with said second end of said ball passageway, said ball support means slidably disposed within said ball guide means;

(e) ball dispensing means for selectively dispensing a one of said golf balls from said ball passageway into said ball guide means, said ball dispensing means coupled to said passageway;

(f) reciprocating means for imparting reciprocating motion to said ball dispensing means, said reciprocating means including a return spring;

(g) actuating means for simultaneously actuating both said ball support means and said ball dispensing means, said actuating means including a pedal pivotally coupled to a substantially linear main shaft, said main shaft having first and second ends, said first end pivotally coupled to a one of said opposing ends of said base;

(h) said reciprocating means including coupling means for operatively coupling said reciprocating means to said second end of said main shaft; and (i) a riser rod, said riser rod operatively coupled to said ball support means, said riser rod and said ball support means movable by actuation of said main shaft.

12. An apparatus as recited in claim 11, wherein said ball dispensing means reciprocates between a first position and a second position, said first position allowing a first of one of said balls to travel down said ball passageway to said ball support means while simultaneously inhibiting the travel of said remaining balls in said ball passageway, said second position allowing a second of one of said balls in said ball passageway to be readied for dispensing.

13. An apparatus as recited in claim 12, wherein said actuating means:

(a) a bracket disposed about said main shaft; and (b) a height adjustment means coupled to said bracket, said height adjustment means limiting the vertical travel of said main shaft and said ball support means.

14. An apparatus as recited in claim 11, wherein said elevating means includes an air cylinder coupled to said main shaft.

15. An apparatus as recited in claim 11, wherein said ball dispensing means comprises:

(a) an upper arm, said upper arm having first and second ends;

(b) a lower arm, said lower arm having first and second ends;

(c) said upper and lower arms being separated by a gap, said first ends of said upper and lower arms extending into said ball passageway, said upper and lower arms slidably disposed in said ball passageway;

(d) said second ends of said upper and lower arms coupled to a plate.

16. An apparatus as recited in claim 15, wherein the width of saie gap between said upper and lower arms is approximate to the diameter of a golf ball.

17. An apparatus as recited in claim 15, wherein said upper and lower arms are substantially elongate, whereby said upper and lower arms effectively block said ball passageway, and inhibit the passage of said golf balls.

18. An apparatus as recited in claim 15, wherein said upper and lower arms are substantially tapered at said first ends.

* * * * *